US006946797B2

(12) United States Patent
Eisemann

(10) Patent No.: US 6,946,797 B2
(45) Date of Patent: Sep. 20, 2005

(54) METAL HALIDE FILL, AND ASSOCIATED LAMP

(75) Inventor: Hans Eisemann, Berlin (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 251 days.

(21) Appl. No.: 10/397,534

(22) Filed: Mar. 27, 2003

(65) Prior Publication Data

US 2003/0184231 A1 Oct. 2, 2003

(30) Foreign Application Priority Data

Apr. 2, 2002 (DE) ..... 102 14 631

(51) Int. Cl.[7] ..... H01J 17/20; H01J 61/20; H01J 61/18; H01J 61/12

(52) U.S. Cl. ..... 313/640; 313/637; 313/638; 313/639; 313/641; 313/642; 313/643

(58) Field of Search ..... 313/637–643

(56) References Cited

U.S. PATENT DOCUMENTS

| | | | | |
|---|---|---|---|---|
| 3,331,982 A | * | 7/1967 | Waymouth et al. | 313/642 |
| 3,575,630 A | | 4/1971 | Edris | |
| 6,400,084 B1 | * | 6/2002 | Eisemann | 313/640 |
| 6,528,946 B2 | * | 3/2003 | Ishigami et al. | 313/637 |

FOREIGN PATENT DOCUMENTS

| | | |
|---|---|---|
| DE | 35 12 757 | 10/1986 |
| DE | 199 07 301 | 8/2000 |
| EP | 0 883 160 | 12/1998 |

* cited by examiner

*Primary Examiner*—Joseph Williams
*Assistant Examiner*—Matt Hodges
(74) *Attorney, Agent, or Firm*—William E. Meyer

(57) ABSTRACT

A metal halide fill for forming an ionizable fill comprising at least one inert gas, mercury, and at least one halogen, the fill additionally comprising the following constituents: Mn halide and V halide. This fill may in particular be present in the discharge vessel of a metal halide lamp.

16 Claims, 4 Drawing Sheets

METAL HALIDE FILL, AND ASSOCIATED LAMP

TECHNICAL FIELD

The invention is based on a metal halide fill and associated lamp for a high-pressure discharge lamp. It deals in particular with fills for lamps with warm white or neutral white luminous colors. In addition, the invention relates to an associated lamp, which is filled with this fill.

BACKGROUND ART

In order to achieve warm white and neutral white luminous colors, metal halide discharge lamps generally contain sodium. For example, U.S. Pat. No. 3,575,630 describes a lamp which contains a metal halide fill which includes the elements Na, Tl and Zr, and which has a warm white luminous color. A further example is the lamp described in EP-A 883 160. This lamp has a metal halide fill which includes the elements Na, Sc, and other constituents, such as Mn. This lamp is dimmable.

Metal halogen discharge lamps having a discharge vessel made from glass and a sodium-containing fill are known to have the drawback of sodium diffusion through the discharge vessel, which reduces the service life of the lamps. The sodium diffusion has to be reduced by means of additional measures, for example shielding of the supply conductor in the vicinity of the discharge vessel, which increases the production costs of the lamp. A further drawback of sodium-containing metal halide discharge lamps is their relatively low color rendering. An Na—Sc-containing metal halide discharge lamp with a neutral white luminous color has, for example, typical values for the general color rendering index Ra=70 and special color rendering index R9=0.

U.S. Ser. No. 09/499,099, which corresponds to DE-A 199 07 301 describes a metal halide fill which includes Mn but does not include Na for metal halide discharge lamps in order to obtain warm white and neutral white luminous colors. Substitution of sodium eliminates the additional measures for reduction of sodium diffusion in the lamps which are filled with this fill. Furthermore, the lamps with the Mn-containing fill achieve high values for the color rendering, with Ra>95. However, the light yield and lamp output are relatively low. For example, at a 250 W inductor, which is also used for Na high-pressure vapor lamps, the lamp output is typically 240 W.

Finally, DE-A 35 12 757 has disclosed a fill for metal halide lamps which contains a metal silicide, such as $V_5Si_3$. In addition, the fill contains rare earth halide or Sc halide and the corresponding rare earth oxyhalide and/or Sc oxide. The silicide in this case acts as a halogen getter.

It is known that incandescent lamps and halogen incandescent lamps, which are Planckian radiators, can be dimmed without problems. However, if metal halide discharge lamps with a reduced lamp output are operated (cf. the abovementioned EP 883 160), their color locus moves away from the Planckian locus. The lamps lose their white luminous color and the color rendering deteriorates.

FIG. 1 (prior art) shows a color locus diagram for a metal halide lamp which is capped on two sides and has an output of 250 W and a neutral white fill (HQI-TS 250W/NDL produced by OSRAM) as an example, which has an Na-containing metal halide fill. The output of the lamp was reduced to half its light flux in stages approximately from 250 W to 160 W at an electronic ballast. As the output decreases, the color locus of the lamp migrates out of the region of the isotemperature lines. As a result, the lamp becomes increasingly greenish.

DISCLOSURE OF THE INVENTION

It is an object of the present invention to provide a metal halide fill for metal halide discharge lamps, the fill is forming an ionizable fill including at least one inert gas, mercury, including at least one halogen, the fill comprising manganese, which does not contain any sodium and is suitable for a lamp generating a neutral white to daylight-like luminous color.

This object is achieved by the following features: namely that the fill comprises at least the following constituents: Manganese halide (Mn halide) and Vanadium halide (V halide). Particularly advantageous configurations are to be found in the dependent claims.

The invention uses a metal halide fill which comprises halides of Vanadium (V) and Manganese (Mn). These can advantageously be combined with other halides of the elements Cs, Dy, Tl, Ho, Tm.

It is a further object of the present invention to provide a metal halide lamp having a discharge vessel and two electrodes and containing an ionizable fill including at least one inert gas, mercury, including at least one halogen, the fill comprising manganese, which lamp is generating a neutral white to daylight-like luminous color without the use of sodium.

A particular advantage of the invention is that it can be used to achieve a higher light yield and lamp output as well as a high color rendering index of at least Ra=95 and a high red rendering index of at least R9=70.

A further advantageous aspect of the invention is that the metal halide discharge lamp which is filled with this fill has very good dimming properties, since the color locus migration as the output decreases is approximately parallel to the Planckian locus, and nevertheless a high color rendering is retained.

BRIEF DESCRIPTION OF THE DRAWINGS

The invention is to be explained in more detail below with reference to a plurality of exemplary embodiments. In the drawings.

BEST MODE FOR CARRYING OUT THE INVENTION

Figure 1:
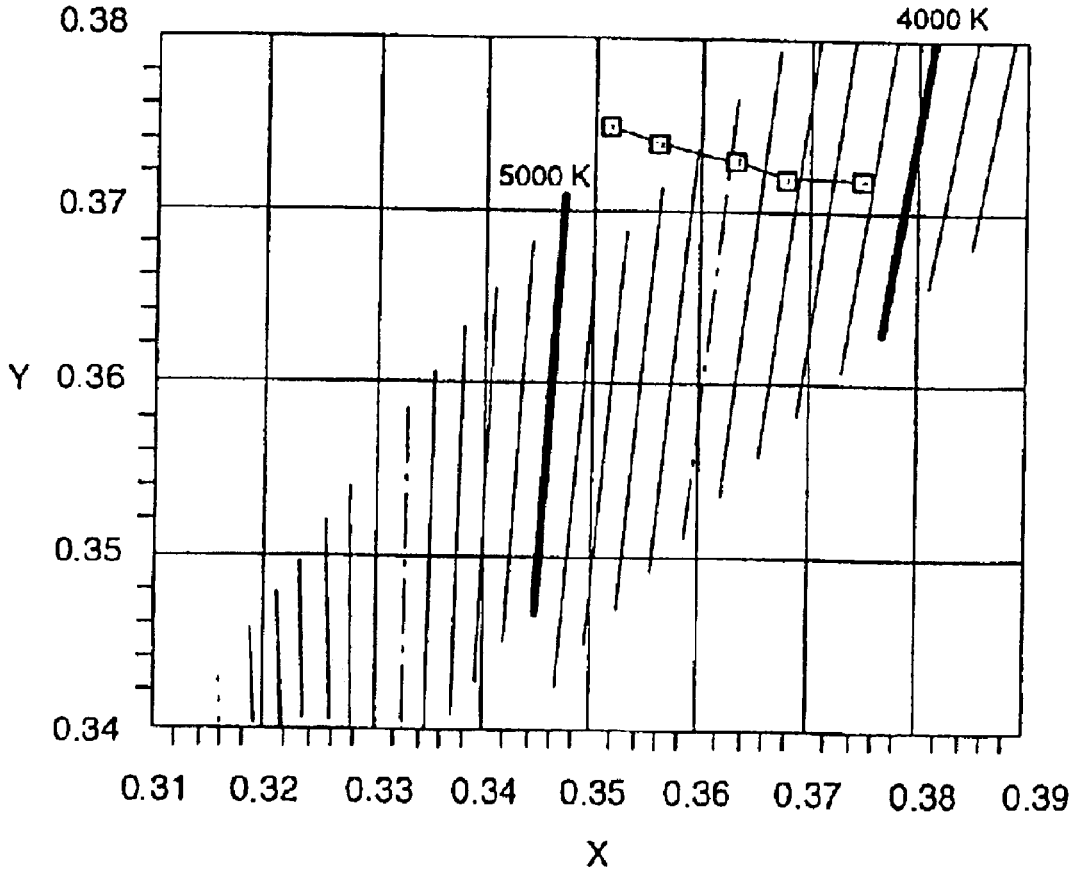
FIG. 1 shows a color locus diagram for a lamp from the prior art.
Figure 2:
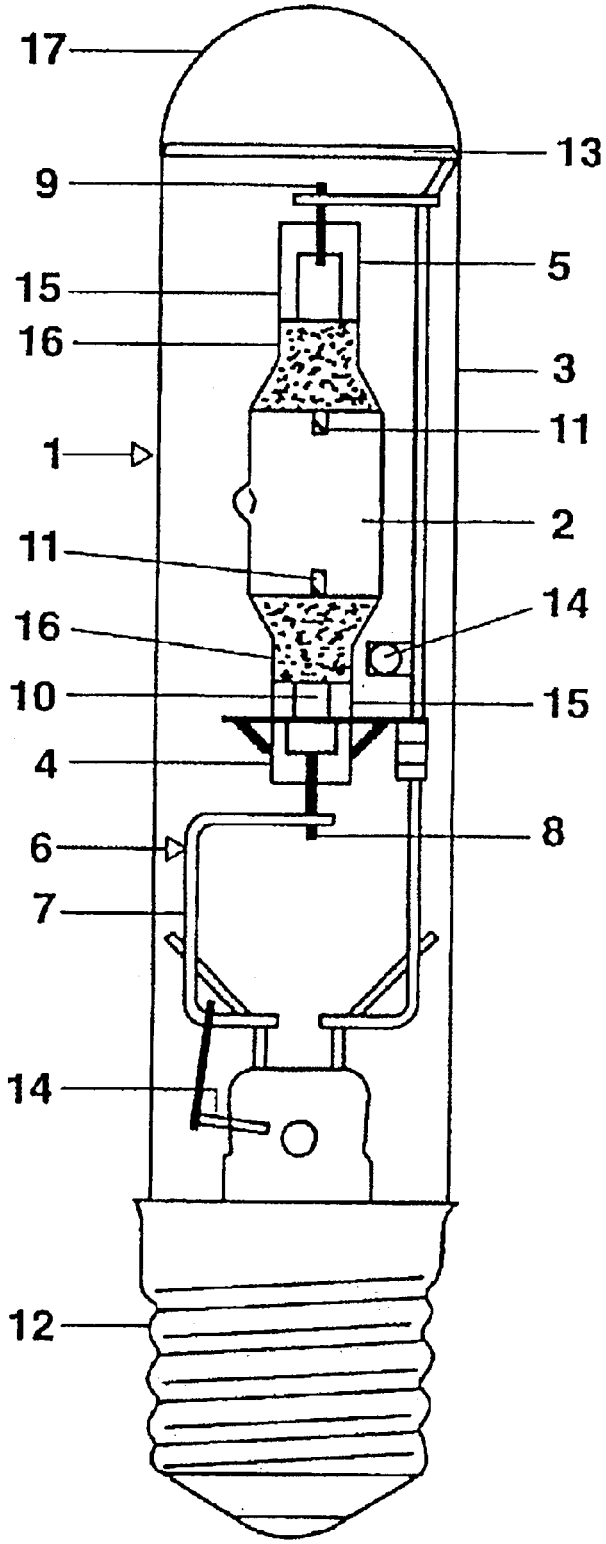
FIG. 2 shows a metal halide lamp according to the invention in section.

An exemplary embodiment of a 250 W metal halide lamp 1 is diagrammatically depicted in FIG. 2. It comprises a discharge vessel 2 which is made from quartz glass, is pinched on two sides and is surrounded by a cylindrical, evacuated outer bulb 3 made from hard glass which has been capped on one side. One end of the outer bulb 3 has a rounded dome 17, whereas the other end has a threaded cap 12. A holding frame 6 fixes the discharge vessel 2 axially inside the outer bulb 3. The holding frame 6 comprises two feed wires, of which one is connected to the supply conductor 8 close to the cap of the discharge vessel 2. The other feed wire is guided by means of a solid metal supporting wire, which extends along the discharge vessel 2, to the supply conductor 9 at the opposite end from the cap. It also has a guide element 15 (in the form of a stamped metal sheet) at the cap end and a support 13 in the vicinity of the dome 17, in the form of part of a circle. The ends 4, 5 of the discharge vessel 2 are provided with a heat-reflecting coating 16. In addition, a getter material 14 which has been applied to a small metal plate, is welded to the holding frame 6. The volume of the discharge vessel 2 is approx. 5.2 ml. The distance between the electrodes 11 is 27.5 mm. 56 mbar Ar is present in the discharge vessel as the base gas. To reduce the breakdown voltage, it is alternatively possible to use a Penning mixture with Ne:Ar=99:1 as the base gas.

The discharge vessel 2 is preferably operated inside an outer bulb 3, which has been evacuated for particularly good color rendering. If the arc tube contains the abovementioned Penning mixture, an outer bulb gas mixture comprising 600 mbar $N_2$ or 450 mbar $CO_2$ and additionally 50 mbar Ne is used to increase the service life.

Figure 3:
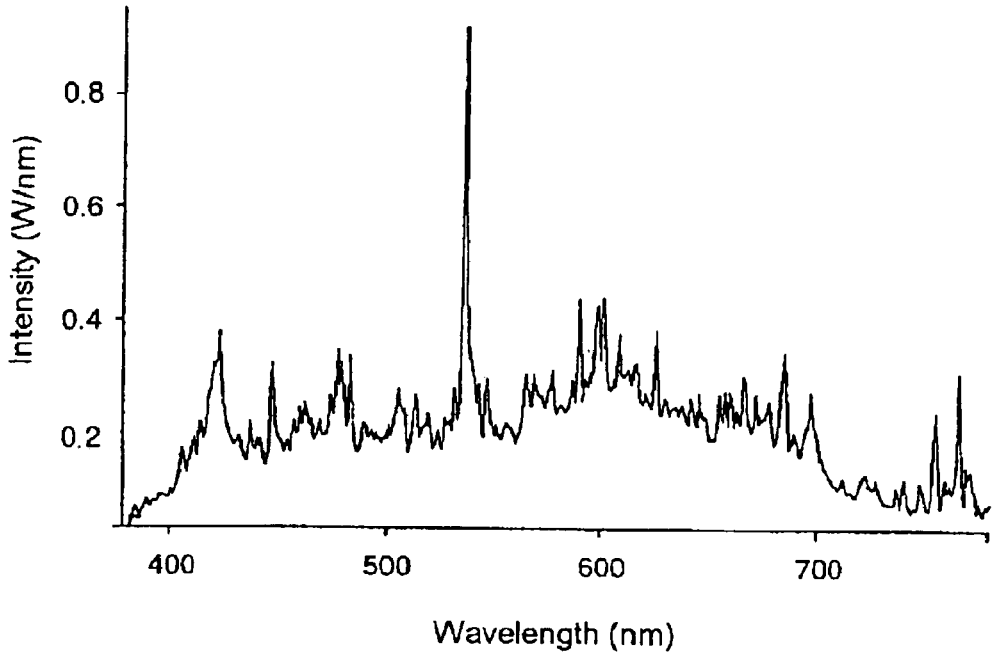
FIG. 3 shows a spectrum for a lamp as shown in FIG. 2.

FIG. 3 shows the spectrum of a lamp with an operating time of 100 h in accordance with the exemplary embodiment shown in FIG. 2, the discharge vessel of which contains 12.2 mg of Hg and the metal halide fill shown in Table 1.

TABLE 1

| Fill | Metal halide content (% by weight) | | | | | | |
|---|---|---|---|---|---|---|---|
| Total mass (mg) | CsI | $DyI_3$ | TlI | $HoI_3$ | $TmI_3$ | $MnI_2$ | $VI_2$ |
| 7.0 | 14.3 | 29.4 | 9.9 | 9.0 | 9.0 | 26.1 | 2.3 |

At the conventional ballast, the lamp has a very similar color temperature of 4400 K, is around three threshold value units below the Planckian locus, has a general color rendering index Ra=97, a specific color rendering index for red of R9=74 and a light yield of around 82 lm/W. The lamp output is 247 W.

Therefore, the lamp in accordance with the exemplary embodiment has a significantly better color rendering than lamps with sodium-containing metal halide fills and a light yield which is higher by 5 lm/W than lamps with Mn-containing metal halide fills without V.

Figure 4:
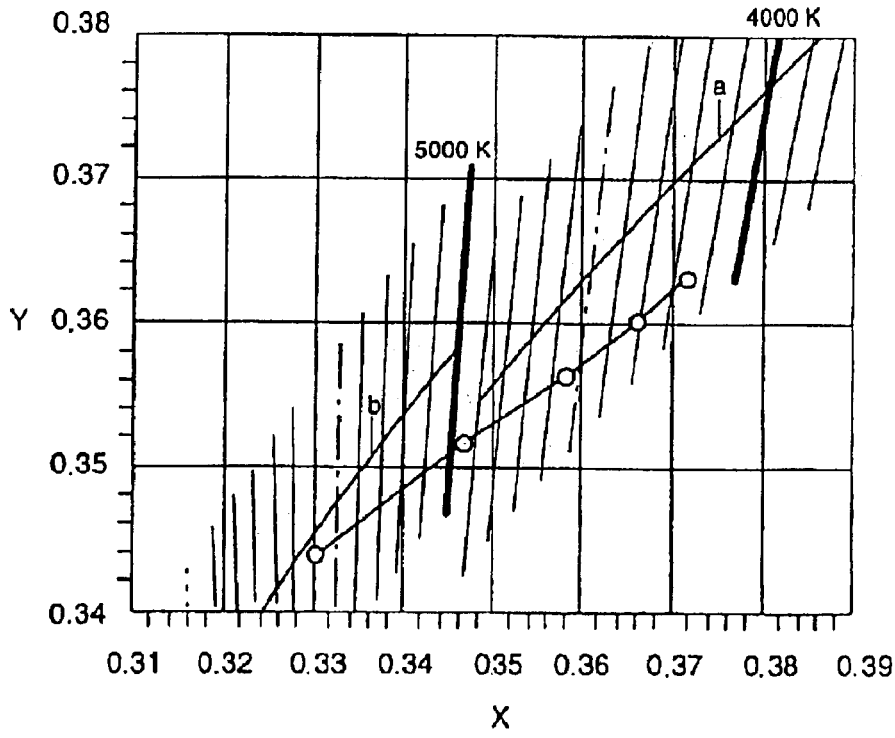
FIG. 4 shows a color locus diagram for a lamp as shown in FIG. 2.

FIG. 4 shows the color locus diagram of an HQI-T 250W/NDL lamp in accordance with the exemplary embodiment described above in connection with FIG. 2, which has been operated at an electronic ballast. At 160 W, the light flux is half the value of 250 W. In accordance with FIG. 4, the color locus migration as the output drops from 250 W to 160 W is approximately parallel to the Planckian locus (a) and reaches the daylight curve (b). The distances from the Planckian locus and the daylight curve are less than three threshold value units. The lamp retains its white luminous color.

Figure 5:
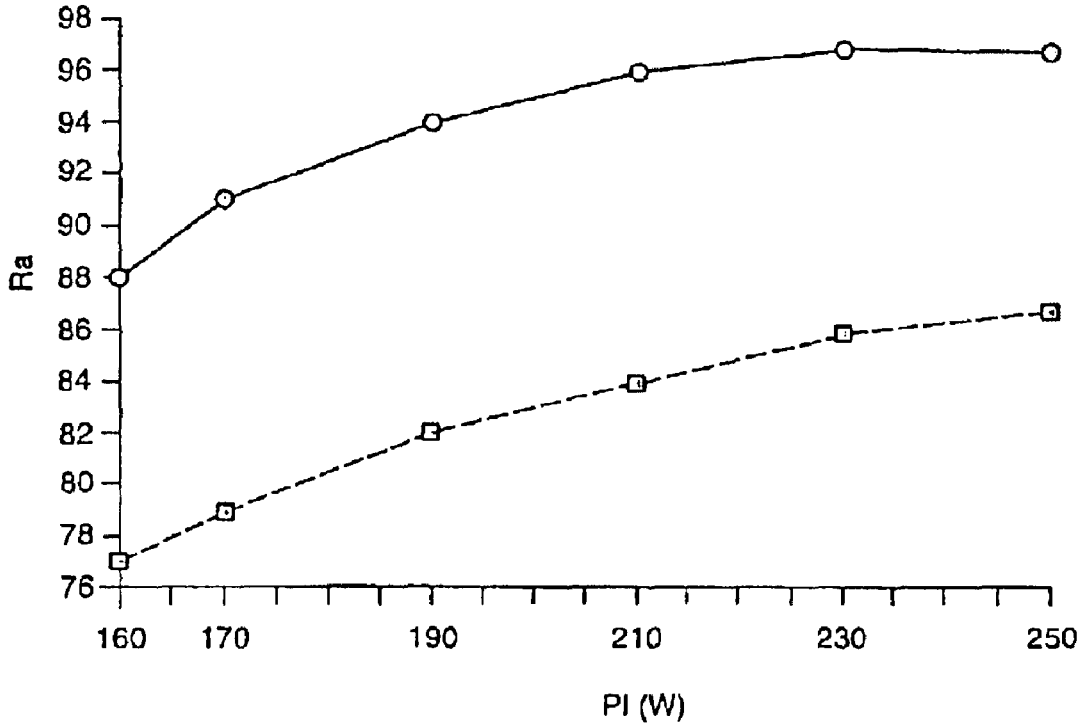
FIG. 5 shows the color rendering index Ra for a lamp as shown in FIG. 2.
Figure 6:
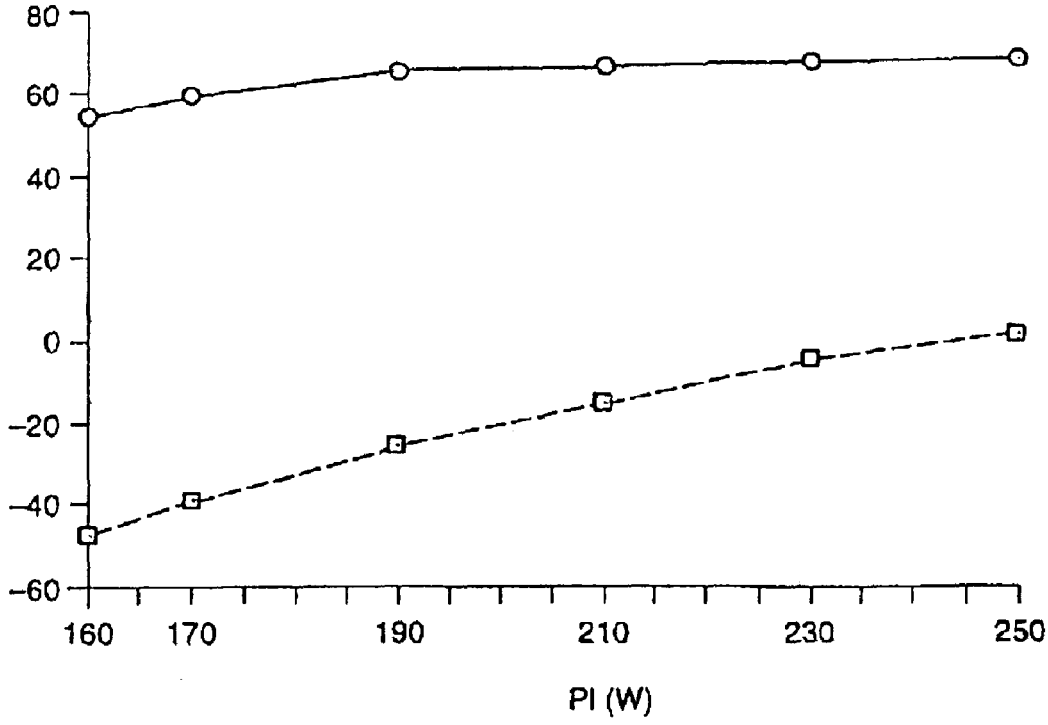
FIG. 6 shows the red rendering index R9 for a lamp as shown in FIG. 2.

FIGS. 5 and 6 show the general color rendering index Ra and specific color rendering index R9 as a function of the lamp output. In accordance with FIGS. 5 and 6, in the HQI-T 250W/NDL lamp with the Mn-V-containing fill, as the output decreases the general color rendering index Ra remains greater than 88 and the specific color rendering index R9 remains greater than 54. By contrast, with the HQI-TS 250 W/NDL lamp with the Na-containing fill, the values for the general color rendering index drop to 77 and for the specific color rendering index R9 to −48.

An Mn halide: V halide ratio of from 5:1 to 20:1 is preferred. A fill which contains the following amounts of metal halides: Cs halide 10 to 20% by weight, Dy halide 25 to 35% by weight, Tl halide 6 to 12% by weight, Ho halide 8 to 14% by weight, Tm halide 8 to 14% by weight, Mn halide 23 to 30% by weight and V halide 1 to 4% by weight, is particularly advantageous.

The halides of Cs, Dy, Tl, Ho and/or Tm can be added depending on whether it is desired to optimize the R9 or the light yield or the color temperature. In each case, a minimum quantity of 0.1% by weight is recommended in order to have a measurable effect.

What is claimed is:

1. A metal halide fill for forming an ionizable lamp fill comprising: at least one inert gas, mercury, at least one halogen, the fill including manganese, wherein the fill including at least the following constituents: Mn halide and V halide.

2. The metal halide fill as claimed in claim 1, wherein at least one halide of the metals selected from the group consisting of Cs, Dy, Tl, Ho, Tm is additionally used.

3. A metal halide lamp comprising: a discharge vessel and two electrodes and containing an ionizable fill including at least one inert gas, mercury, including at least one halogen, the fill including manganese, wherein the fill including at least the following constituents: Mn halide and V halide.

4. The metal halide lamp as claimed in claim 3, wherein the quantity of Mn in the fill amounts to from 0.01 to 50 $\mu$mol per ml of volume of the discharge vessel.

5. The metal halide lamp as claimed in claim 3, wherein the Mn:V ratio is between 0.3 and 120.

6. The metal halide lamp as claimed in claim 3, wherein the fill additionally contains Cs in an amount of from 0 to 30 $\mu$mol per ml of volume of the discharge vessel.

7. The metal halide lamp as claimed in claim 3, wherein the fill additionally contains Dy in an amount of from 0 to 35 $\mu$mol per ml of volume of the discharge vessel.

8. The metal halide lamp as claimed in claim 3, wherein the fill additionally contains Ti in an amount of from 0 to 15 $\mu$mol per ml of volume of the discharge vessel.

9. The metal halide lamp as claimed in claim 3, wherein the fill additionally contains Ho in an amount of from 0 to 18 $\mu$mol per ml of volume of the discharge vessel.

10. The metal halide lamp as claimed in claim 3, wherein the fill additionally contains Tm in an amount of from 0 to 18 $\mu$mol per ml of volume of the discharge vessel.

11. The metal halide lamp as claimed in claim 3, wherein the halogens used to form halides are iodine and/or bromine.

12. The metal halide lamp as claimed in claim 3, wherein the discharge vessel is arranged inside an outer bulb.

13. The metal halide lamp as claimed in claim 12, wherein the space between discharge vessel and outer bulb is evacuated or contains a gas fill.

14. The metal halide lamp as claimed in claim 13, wherein the gas fill comprises 100 to 700 mbar $N_2$ or 50 to 500 mbar $CO_2$.

15. The metal halide lamp as claimed in claim 14, wherein the gas fill additionally contains from 1 to 500 mbar Ne.

16. The metal halide lamp as claimed in claim 3, wherein the quantity of V in the fill amounts to from 0.01 to 25 $\mu$mol per ml of volume of the discharge vessel.

* * * * *